US007357100B2

(12) United States Patent
Waseda et al.

(10) Patent No.: US 7,357,100 B2
(45) Date of Patent: Apr. 15, 2008

(54) HEAT EXCHANGER TUBE PANEL MODULE, AND METHOD OF CONSTRUCTING EXHAUST HEAT RECOVERY BOILER USING THE SAME

(75) Inventors: Isao Waseda, Kure (JP); Atsuo Kawahara, Kure (JP); Mitsugi Musashi, Kure (JP); Toshinori Shigenaka, Kure (JP)

(73) Assignee: Babcock-Hitachi Kabushiki Kaisha, Tokyo (JP)

( * ) Notice: Subject to any disclaimer, the term of this patent is extended or adjusted under 35 U.S.C. 154(b) by 123 days.

(21) Appl. No.: 10/563,282

(22) PCT Filed: Jul. 30, 2003

(86) PCT No.: PCT/JP03/09657

§ 371 (c)(1),
(2), (4) Date: Jan. 4, 2006

(87) PCT Pub. No.: WO2005/012790

PCT Pub. Date: Feb. 10, 2005

(65) Prior Publication Data

US 2007/0119388 A1 May 31, 2007

(51) Int. Cl.
*F22B 37/24* (2006.01)

(52) U.S. Cl. ..... 122/511; 122/510; 376/461

(58) Field of Classification Search ..... 122/7 R, 122/510, 511, 494; 376/461, 462; 165/67
See application file for complete search history.

(56) References Cited

U.S. PATENT DOCUMENTS 3,209,734 A * 10/1965 Cooper et al. ..... 122/510
3,644,978 A * 2/1972 Sullivan et al. ..... 29/726

(Continued)

FOREIGN PATENT DOCUMENTS

| | | |
|---|---|---|
| JP | 4-124501 | 4/1992 |
| JP | 2000-018501 | 1/2000 |
| JP | 2001-263602 | 9/2001 |
| JP | 2003-222302 | 8/2003 |

OTHER PUBLICATIONS

English Language Abstract of JP 2001-263602.
English Language Abstract of JP 2000-018501.
English Language Abstract of JP 4-124501.
English Language Abstract of JP 2003-222302.

(Continued)

*Primary Examiner*—Gregory Wilson
(74) *Attorney, Agent, or Firm*—Greenblum & Bernstein, P.L.C.

(57) ABSTRACT

A necessary size and number of modules each obtained by housing a member including heat exchanger tube panels each comprising a heat exchanger tube bundle and headers for the heat exchanger tube bundle, an upper casing of an exhaust heat recovery boiler (HRSG), provided above the heat exchanger tube panels, heat insulators, and heat exchanger tube panel support beams provided on the upper surface of the upper casing into a transportation frame, are prepared according to design specifications of the HRSG, and side casings and a bottom casing except for the ceiling part casing are constructed in advance at a construction site of the HRSG, and the modules are suspended from above between adjacent support beams of the ceiling part to dispose the heat exchanger tube panel support beams of the modules at the set heights of the ceiling part support beams, and the support beams and the ceiling part support beams are connected and fixed via connecting steel plates, whereby the respective modules are transported to the HRSG construction site and can be easily constructed.

5 Claims, 16 Drawing Sheets

U.S. PATENT DOCUMENTS

| | | | | |
|---|---|---|---|---|
| 4,685,426 | A | | 8/1987 | Kidaloski et al. |
| 5,339,891 | A | * | 8/1994 | Kidaloski et al. ..... 165/67 |
| 5,557,901 | A | * | 9/1996 | Hoosic et al. ..... 52/506.03 |
| 5,722,354 | A | * | 3/1998 | Sansoucy ..... 122/510 |
| 6,058,893 | A | * | 5/2000 | Patel ..... 122/510 |

OTHER PUBLICATIONS

Uehiro et al., State of the Art Heat Recovery Steam Generation for Combined Cycle Power Plant, The Hitachi Hyoron, vol. 84, No. 2, pp. 13-16 (2002). Together with a partial English language translation.

U.S. Appl. No. 10/565,298 to Waseda et al., filed Jan. 20, 2006.

* cited by examiner (a)

(b)

(a)

(b)

HEAT EXCHANGER TUBE PANEL MODULE, AND METHOD OF CONSTRUCTING EXHAUST HEAT RECOVERY BOILER USING THE SAME

TECHNICAL FIELD

The present invention relates to an exhaust heat recovery boiler (hereinafter, referred to occasionally as HRSG) to be used for a combined cycle power plant, more specifically, an exhaust heat recovery boiler construction method (modularization method) and a heat exchanger tube panel module structure to be used with this method.

BACKGROUND ART

A combined cycle power plant using a gas turbine has a high heat efficiency in comparison with a thermal power plant using a coal-fired boiler, and the amount of SOx and soot and dust generated from the combined cycle power plant is small since it uses natural gas mainly as fuel, and therefore, the burden on exhaust gas purification is small, whereby the combined cycle power plant has gained attention as a power plant with great future potential. Furthermore, the combined cycle power plant is excellent in load responsibility, and has gained attention simultaneously as a power generation method which can rapidly change its power output in accordance with power demands, suitable for high-frequency start and stop (daily start and daily stop).

The combined cycle power plant comprises main components including an HRSG for generating steam by using a power generating gas turbine and exhaust gas from the gas turbine and a steam turbine for generating power by using steam obtained by the HRSG.

FIG. 1 is a schematic block diagram of a horizontal HRSG having a supporting burner inside, wherein the HRSG has a casing 1 that is a gas duct in which exhaust gas G from the gas turbine flows horizontally, the supporting burner 2 is disposed at the inside of the casing 1 at an inlet of the gas turbine exhaust gas G, and at the downstream side thereof, a heat exchanger tube bundle 3 is provided. The heat exchanger tube bundle 3 is generally provided with, in order from the upstream side to the downstream side, a super heater 3*a*, an evaporator 3*b*, and an economizer 3*c*, and in some cases, provided with a reheater (not shown).

Equipment including the HRSG that compose the combined cycle power plant have small capacities in comparison with equipment composing a high-capacity thermal power plant, and can be transported after being assembled up to a stage close to completion within a plant equipment manufacturing factory, and in this case, installation on site is comparatively easy. Therefore, installation is completed in a short period in comparison with high-capacity equipment composing the thermal power plant.

However, even under these circumstances, the HRSG is not small in size, and its installation requires enormous labor and time. For example, for conventional installation of an HRSG, a bundle 3 of a necessary number of heat exchanger tubes each of which includes one hundred and several tens of heat exchanger tubes and headers as one unit are transported to a construction site, and heat exchanger tube panels are suspended for each unit from support beams provided on the ceiling of the HRSG casing constructed in advance at a construction site. Such work of suspending thousands or ten of thousands of heat exchanger tubes at a high place is not only dangerous but also results in an extended work period and high construction costs.

Therefore, a technical development has been strongly demanded which makes the construction of an HRSG easy by dividing the heat exchanger tube bundle 3 of the HRSG into several modules and modularizing the equipment composing the HRSG so that the modules are completed as one unit within a manufacturing factory and installation is completed by only assembling the unit.

Particularly, considering the circumstances that supply of HRSG construction parts and securing of experienced construction personnel outside Japan are difficult, the modularization method is very advantageous in which, within a domestic equipment manufacturing factory having a technical capacity necessary for manufacturing equipment composing an HRSG, a full management system for quality control or process management, etc., and a large number of skilled personnel, the equipment is completed as part products divided into a plurality of modules, transported to the site and assembled. Particularly, development of a method in which an HRSG whose capacity is comparatively great among equipment composing a combined cycle power plant is manufactured as a plurality of divided modules in advance in a factory and the modules are assembled at the HRSG construction site has been demanded.

An object of the invention is to provide an advantageous HRSG construction method in which components of an exhaust heat recovery boiler are manufactured and divided into a plurality of modules in a factory and then the modules are transported to the site and assembled, wherein heat exchanger tube panel modules are employed in this method.

Another object of the invention is to provide an HRSG construction method which prevents heat exchanger tube panels from being damaged during transportation, reduces transportation costs simultaneously, and reduces members to be wasted after installation, and heat exchanger tube modules to be used in this method.

DISCLOSURE OF THE INVENTION

The present invention provides a construction method for an exhaust heat recovery boiler which generates steam by arranging a heat exchanger tube bundle 3 within a casing 1 that forms a gas duct for almost horizontal flows of exhaust gas, wherein modules 25 each of which is obtained by housing a member including heat exchanger tube panels 23 each comprising a plurality of heat exchanger tubes 6 and corresponding headers 7 and 8, an upper casing 20 provided above the heat exchanger tube panel 23, and support beams 22 for the heat exchanger tube panel provided on the upper surface of the upper casing 20 in a transportation frame 24 that is formed of a rigid body and used only during transportation, are manufactured by a necessary size and number according to design specifications of the exhaust heat recovery boiler, structural members for supporting the modules 25, including ceiling part support beams 33 and 34 and side casings 1*a* and 1*b* and a bottom casing 1*c* of the exhaust heat recovery boiler except for the ceiling part are constructed in advance at a construction site, and at the construction site of the exhaust heat recovery boiler, surfaces of each module 25 which will be set perpendicular to the gas flow are set to the upper and lower sides and each module is erected together with the transportation frame 24, each module 25 is extracted from the inside of the transportation frame 24, and the respective modules 25 are suspended from above between adjacent ceiling part support beams 33, whereby the heat exchanger tube panel support beams 22 of respective modules 25 are disposed at the set heights of the ceiling part support beams 33 and the support beams 22 and 33 are connected and fixed to each other via connecting steel plates 36, 39, and 40.

In the above-mentioned exhaust heat recovery boiler construction method, at a construction site of the exhaust heat recovery boiler, it is possible that surfaces of each module 25 which will be set perpendicular to the gas flow are set to the upper and lower sides and the module is temporarily fixed onto a standing jig 37, the standing jig 37 with the module 25 placed is propped up so that the lengthwise direction of the standing jig 37 is turned to be vertical at a position adjacent to the side casing 1*a* or 1*b* of the exhaust heat recovery boiler by a crane 42, and next, surfaces of the module 25 which will be set perpendicular to the gas flow are arranged so as to be parallel with the side casing 1*a* or 1*b* of the exhaust heat recovery boiler and the standing jig 37 is temporarily fixed to the side casing 1*a* or 1*b*, and the target to be lifted by the crane 42 is changed into the heat exchanger tube panel support beams 22 of the module 25 placed inside the standing jig 37 temporarily fixed to the side casing 1*a* or 1*b*, the module 25 is lifted so as to come off the standing jig 37, and the module 25 lifted by the crane 42 is suspended from above between adjacent ceiling part support beams 33 of the supporting structural members of the exhaust heat recovery boiler.

Furthermore, in the exhaust heat recovery boiler construction method, the following method may be employed in which the heat exchanger tube panel support beams 22 of each module 25 are set at the set heights of the ceiling part support beams 33 and both support beams 22 and 33 are connected and fixed to each other via first connecting steel plates 36, and thereafter, gaps created between the upper casing 20 of each module 25 and the ceiling part support beams 33 are closed by a second steel plate 39, and the upper casing 20, the ceiling part support beams 22, and the second steel plate 39 are connected by means of welding.

Furthermore, it is possible that a heat insulator 13 is provided below the upper casing 20 of each module 25, the upper headers 7 are provided with connecting pipes for circulation of steam or water, and header supports 11 are provided so as to be suspended from the heat exchanger tube panel support beams 22 between the upper casing 20 and the upper headers 7 of each module 25.

Furthermore, the invention provides heat exchanger tube panel modules 25 for construction of an exhaust heat recovery boiler, wherein one module unit comprises the heat exchanger tube module 25 which includes a heat exchanger tube panel module comprising a member including a heat exchanger tube panel 23 which comprises a plurality of heat exchanger tubes and corresponding headers 7 and 8 for the heat exchanger tubes 6, an upper casing 20 provided above the heat exchanger tube panel 23, and support beams 22 for the heat exchanger tube panel provided on the upper surface of the upper casing 20, and a transportation frame 24 that houses the module and is used only during transportation and formed of a rigid body, and the heat exchanger tube panels 23 of the one module unit are provided with vibration isolating supports 18 at predetermined intervals to prevent contact between heat exchanger tubes 6 adjacent to each other in a direction crossing the lengthwise direction of the plurality of heat exchanger tubes.

In the above-mentioned heat exchanger tube panel module 25, a shake preventive fixing member 32 to be disposed between the end of the vibration isolating support 18 and the transportation frame 24 is provided.

In the invention, in the heat exchanger tube panel module 25 obtained by housing a member including the heat exchanger tube panels 23 each including a plurality of heat exchanger tubes 6 and headers 7 and 8 for the heat exchanger tubes, the upper casing 20 provided above the heat exchanger tube panel 23, and the support beams 22 for the heat exchanger tube panel provided on the upper surface of the upper casing 20 inside the transportation frame 24, the heat exchanger tube panels 23 can be fixed by the transportation frame 24 and are prevented from being damaged due to shaking during transportation.

Particularly, by providing shake preventive fixing members 32 between the vibration isolating supports 18, 26, 27, 32 and the transportation frame 24, the effect of preventing damage due to shaking during transportation is increased.

Furthermore, since the supporting structural members including the ceiling part support beams 33 and 34 and the side casings 1*a* and 1*b* and the bottom casing 1*c* of the HRSG except for the ceiling part are constructed in advance at the HRSG construction site, by using the standing jig 37 and the crane 42, the heat exchanger tube panel module 25 is detached from the transportation frame 24 and the heat exchanger tube panel support beams 22 of each module 25 are arranged at the set heights of the ceiling part support beams 33 by being suspended from above between adjacent ceiling part support beams 33, and the support beams 22 and 33 are connected and fixed via the connecting steel plates 36, 39, and 40.

As mentioned above, the heat exchanger tube panel modules 25 are manufactured in a manufacturing factory, and then the modules 25 are transported to the construction site and installed on site, whereby installation of the heat exchanger tube panels 23 is completed along with the casing 1 for an HRSG, the dangerous construction work at the upper side inside the casing 1 of the HRSG is eliminated, setting up of scaffolds and dismounting thereof become unnecessary, and the heat exchanger tube panels 23 can be easily installed in the casing 1 of the HRSG within a short period of time, so that the HRSG can be constructed within a short work period.

BEST MODE FOR CARRYING OUT THE INVENTION

A modularization method of an exhaust heat recovery boiler as an embodiment of the invention is described with reference to the drawings.

Figure 1:
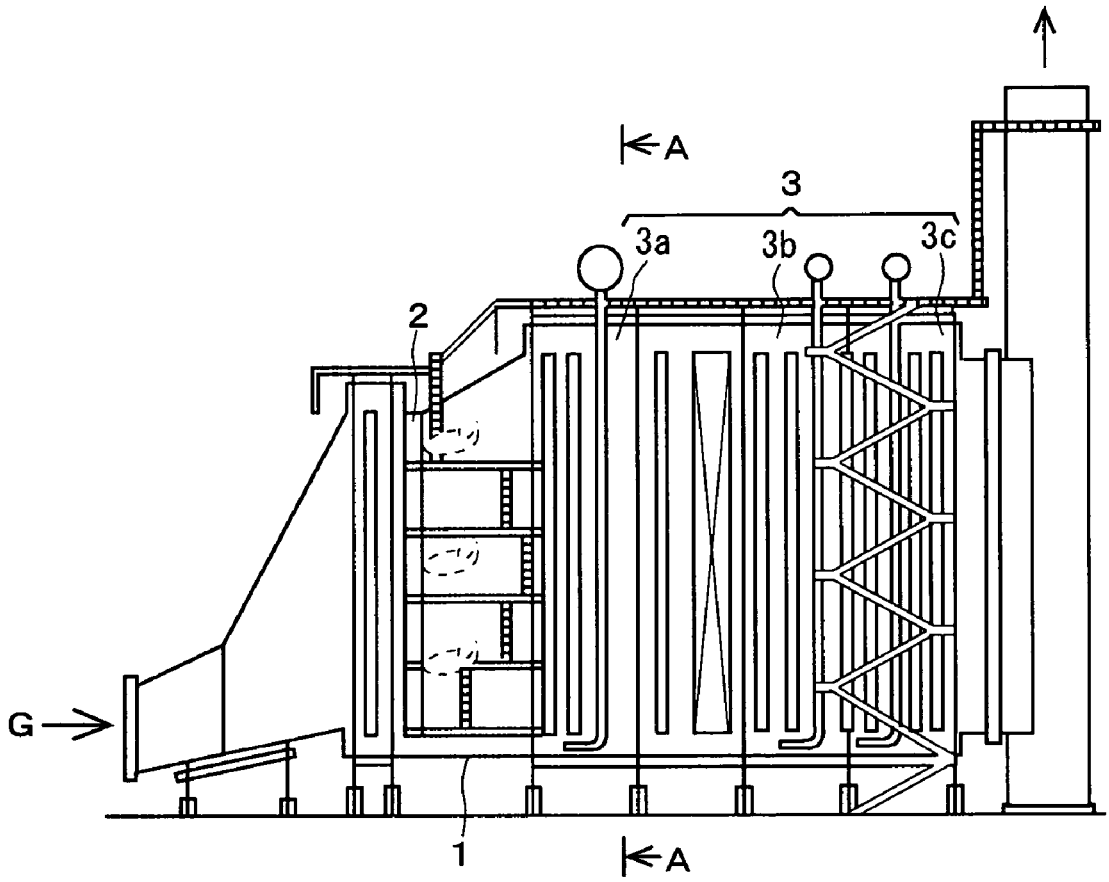
FIG. 1 is a schematic block diagram of a horizontal exhaust heat recovery boiler having a supporting burner inside.
Figure 2:
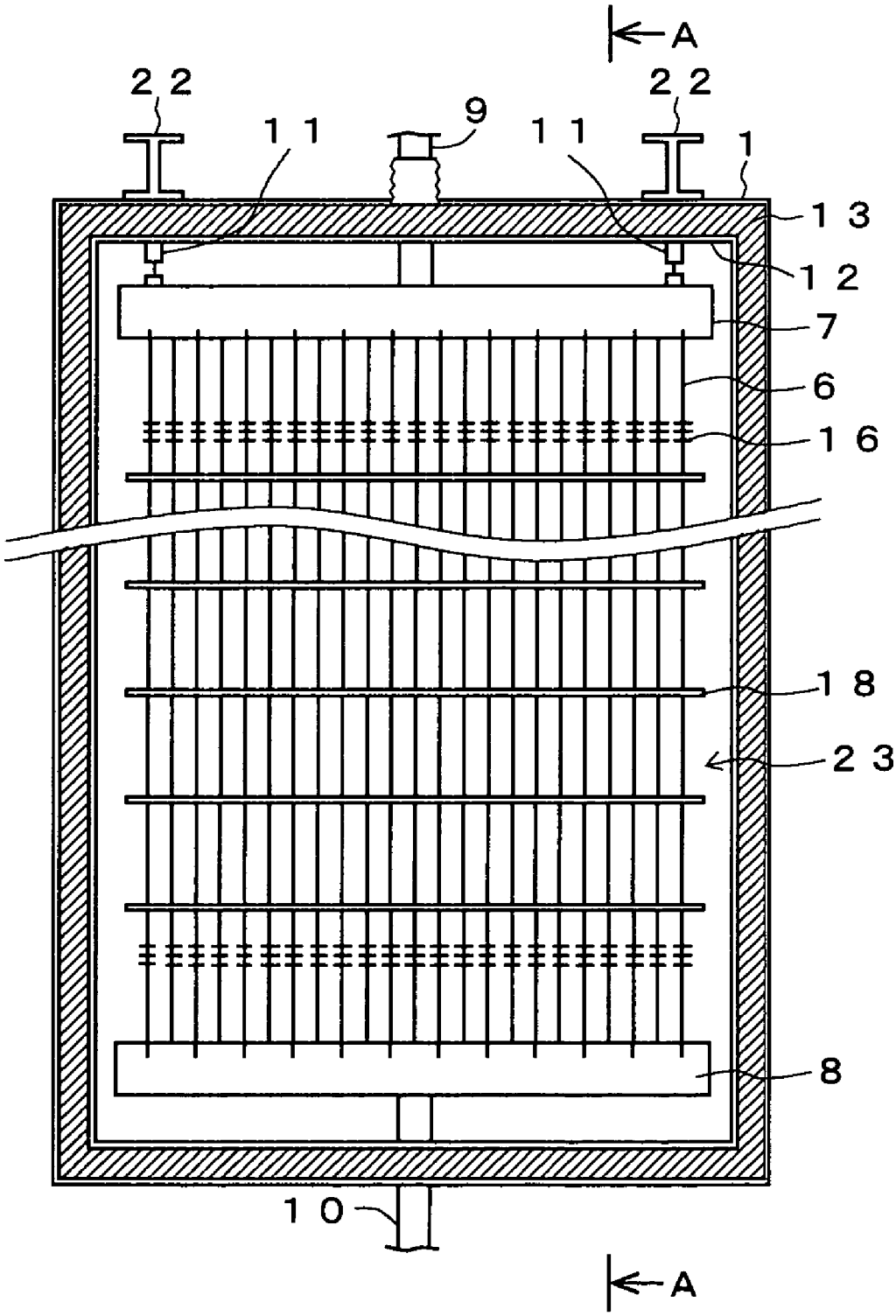
FIG. 2 is a block diagram of a heat exchanger tube bundle disposed inside a casing of the HRSG, viewed in a section orthogonal to a gas flow direction of the exhaust heat recovery boiler.
Figure 3:
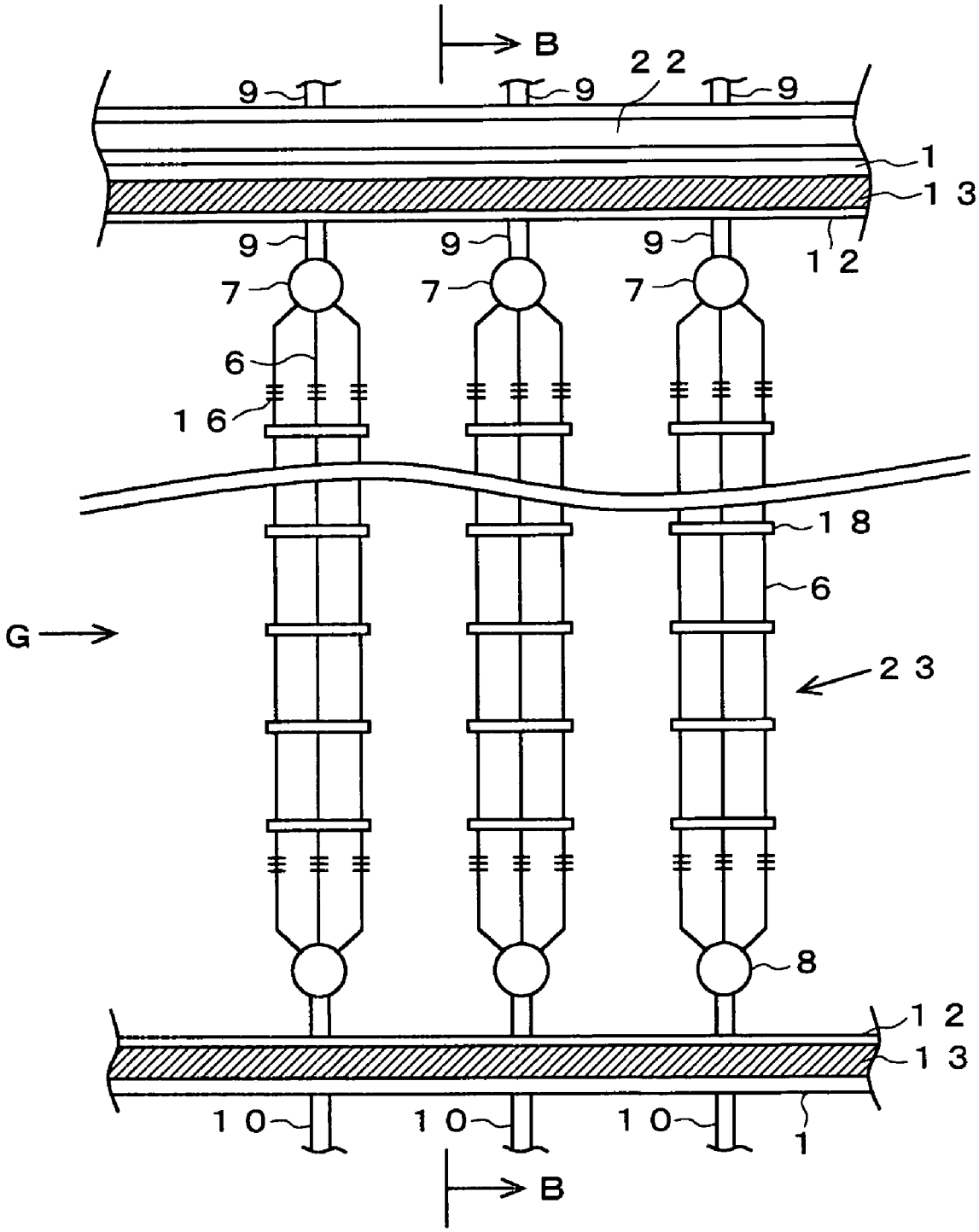
FIG. 3 is a block diagram of the heat exchanger tube bundle disposed inside the casing of the HRSG, viewed in a section in the gas flow direction of the exhaust heat recovery boiler.

FIG. 2 shows a section orthogonal to the gas flow direction of the exhaust heat recovery boiler, and FIG. 3 shows a section in the gas flow direction of the exhaust heat recovery boiler. FIG. 2 corresponds to a sectional view of the arrow along the A-A line of FIG. 1, and FIG. 3 corresponds to a sectional view of the arrow along the A-A line of FIG. 2.

A heat exchanger tube panel 23 of the exhaust heat recovery boiler comprises, as shown in FIG. 2 and FIG. 3, heat exchanger tubes 6, upper headers 7, lower headers 8, upper connecting pipes 9, and lower connecting pipes 10, and the heat exchanger tubes 6 are supported by heat exchanger tube panel support beams 22 via header supports 11 at the upper side. The outer circumference of the heat exchanger tube panel 23 is covered by the casing 1 and an inner casing 12 and an heat insulator 13 filled between the casing 1 and the inner casing 12, and is supported by heat exchanger tube panel support beams 22. Fins 16 (partially shown) are wound around the outer circumferences of the heat exchanger tubes 6, and a plurality of fin-wound heat exchanger tubes 6 are arranged in a staggered manner with respect to the exhaust gas flow direction. When exhaust gas G passes between the heat exchanger tubes 6, if the flow rate thereof becomes higher than a predetermined rate, due to interference between the fluid force of the passing exhaust gas G and the rigidity of the heat exchanger tubes 6 forming the channel of the exhaust gas G, a phenomenon called fluid elastic vibrations in which the heat exchanger tubes 6 self-excitedly vibrate may occur. In order to prevent the fluid elastic vibrations and contacts between the front and back and left and right heat exchanger tubes 6, the heat exchanger tubes are bundled by vibration isolating supports 18 provided in a direction orthogonal to the tube axes.

Figure 4:
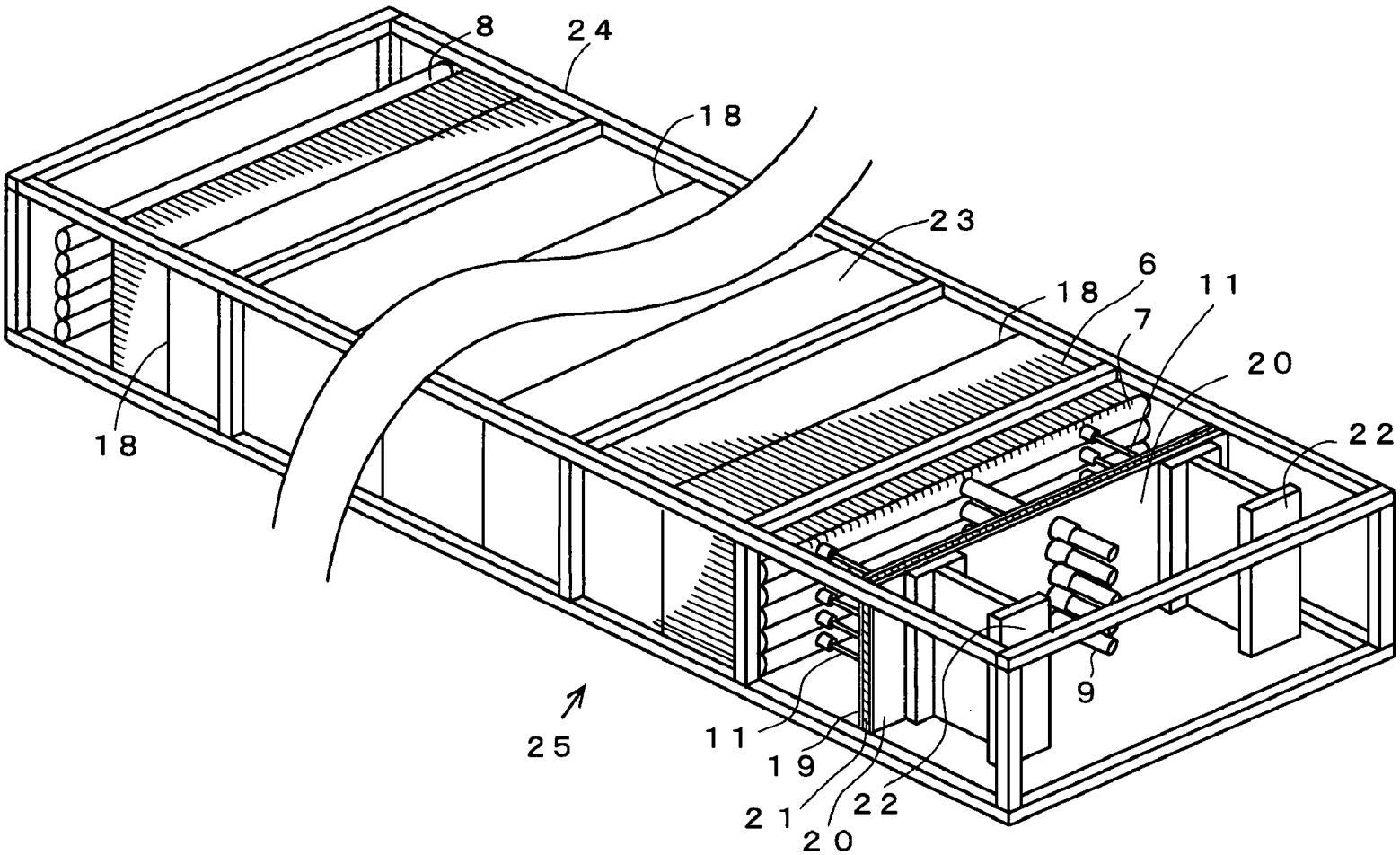
FIG. 4 is a perspective view of a heat exchanger tube panel module.
Figure 5:
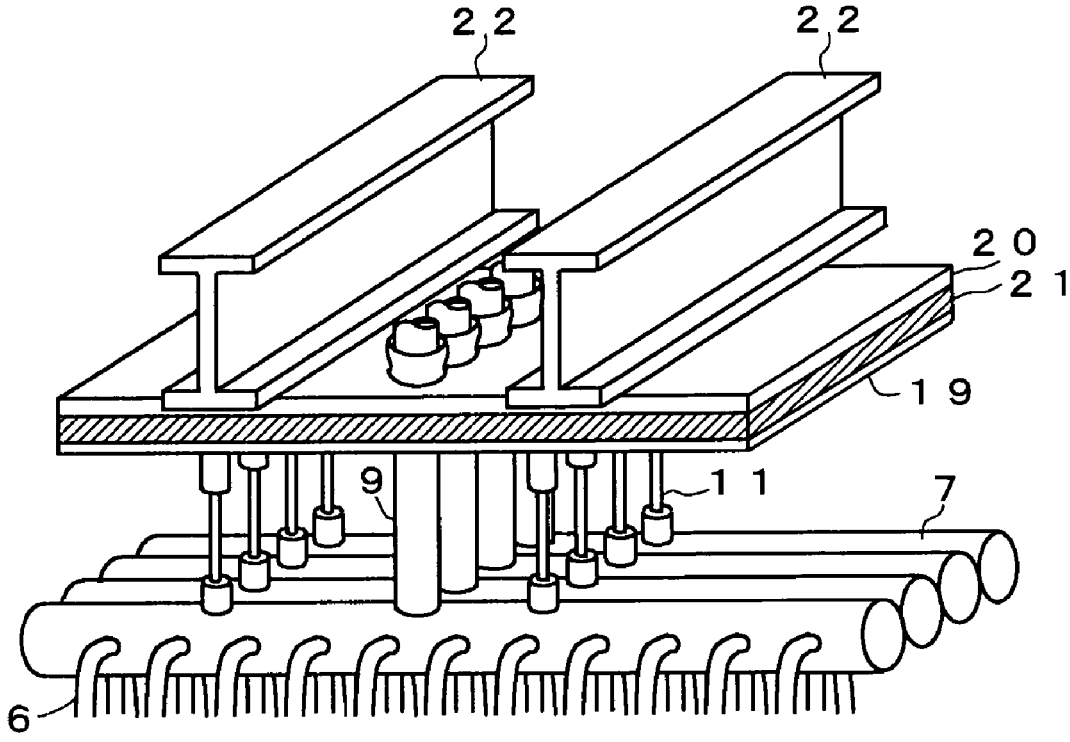
FIG. 5 is a perspective view of upper headers and an upper casing part of the heat exchanger tube panel module.

FIG. 4 is a perspective view of the heat exchanger tube panel module 25. The heat exchanger tube panel 23 comprising a bundle of a plurality of heat exchanger tubes 6 and headers 7 and 8 is divided into a plurality and modularized, and the respective obtained heat exchanger tube panel module 25 (hereinafter, simply referred to as module 25) is housed into a transportation frame 24. One transportation frame 24 houses approximately 600 heat exchanger tubes 6, upper and lower headers 7 and 8 thereof, upper and lower connecting pipes 9 and 10, and furthermore, inner casings 19, heat insulators 21, and upper casings 20, and heat exchanger tube panel support beams 22, etc., for the heat exchanger tubes in a unified manner. FIG. 5 is a perspective view showing the part of the upper headers 7 and the upper casings 1, 12, and 13 (19 through 21).

In an HRSG for a combined cycle power plant whose steam temperature is of a 1300° C. class, the panels are divided into two or three modules 25 in the width direction of the gas duct (direction orthogonal to the gas flow), and divided into six through twelve modules 25 in the gas flow direction due to the layout of the heat exchanger tube bundle and transporting restrictions, and the modules 25 have different sizes in accordance with the layout positions inside the HRSG in some cases. The size of one module 25 is, for example, 26 m in length, 3 through 4.5 m in width, and 1.5 through 4 m in height.

In each module 25, three through eight panels of fin-wound heat exchanger tube panels 23, upper connecting pipes 9 in which heated fluid circulates between the module and the headers of another adjacent module 25, upper casings 20, heat insulators 21 attached to the inner surfaces of the upper casings 20 and inner casings 19 are installed so as to satisfy the size of a completed product after installation at a construction site, and furthermore, on the upper casings 20, a predetermined number of heat exchanger tube panel support beams 22 formed of wide flange beams are attached, and supports 11 for supporting the upper headers 7 are provided inside the upper casings 20 corresponding to the support beams 22. The above-mentioned parts are attached so as to be enclosed by the transportation frame 24 to form one module 25.

The heat exchanger tube panels 23 to be arranged inside the HRSG casing 1 are only suspended and supported by the support beams 22 attached to the upper casings 20, and if they are not fixed by the transportation frame 24, they may be damaged due to shaking during transportation.

Figure 6:
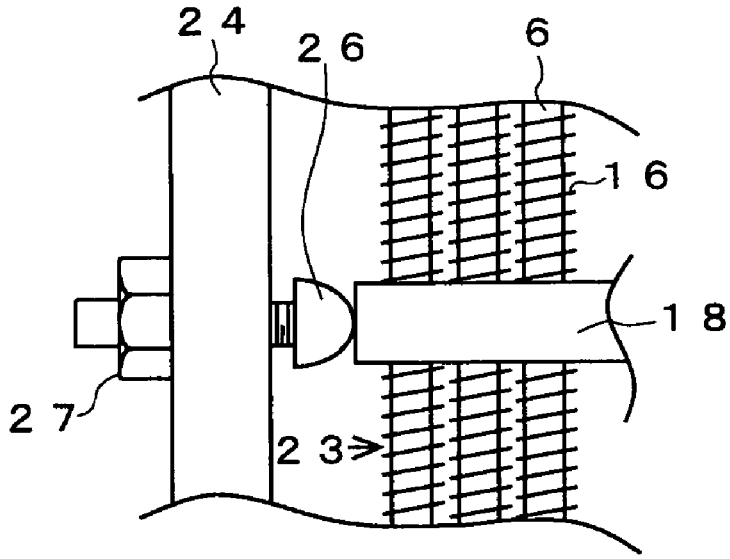
FIGS. 6 are side views of a shake preventive fixing member of the heat exchanger tube panel module.
Figure 6:
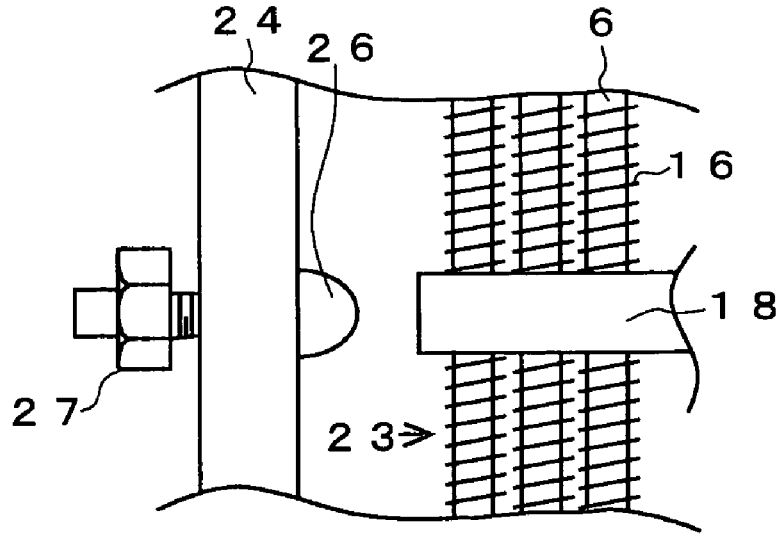

In this embodiment, as shown in FIG. 6, a shake preventive fixing bolt 26 is provided between the vibration isolating support 18 and the transportation frame 24. After the shake preventive fixing bolt 26 that can be pressed is pressed against the end of the vibration isolating support 18 from outside of the transportation frame 24, and then fastened with a lock nut 27 and fixed to the transportation frame 24 via the vibration isolating support 18 (FIG. 6(*a*)). When installing the module 25 at an HRSG construction site, this fastening by the lock nut 27 is loosened to release the pressure of the fixing bolt 26 against the vibration isolating support 18, whereby the module 25 is detached from the transportation frame 24 (FIG. 6(*b*)).

Furthermore, it is also possible that a shake preventive fixing member having a plate with a length corresponding to the gap between the transportation frame 24 and the end of the vibration isolating support 18 is welded to both the transportation frame 24 and the vibration isolating support 18, and this fixing member is cut after transportation although this is not shown.

Furthermore, it is also possible that a timber plate with a thickness corresponding to the gap between the transportation frame 24 and the end of the vibration isolating support 18 is inserted into this gap, and after transportation, this plate is extracted.

Moreover, it is still also possible that a filling material such as sand, a gel material, or the like is filled in necessary portions of the heat exchanger tube panels 23 inside the transportation frame 24, and after transportation, the filling material is extracted.

Figure 7:
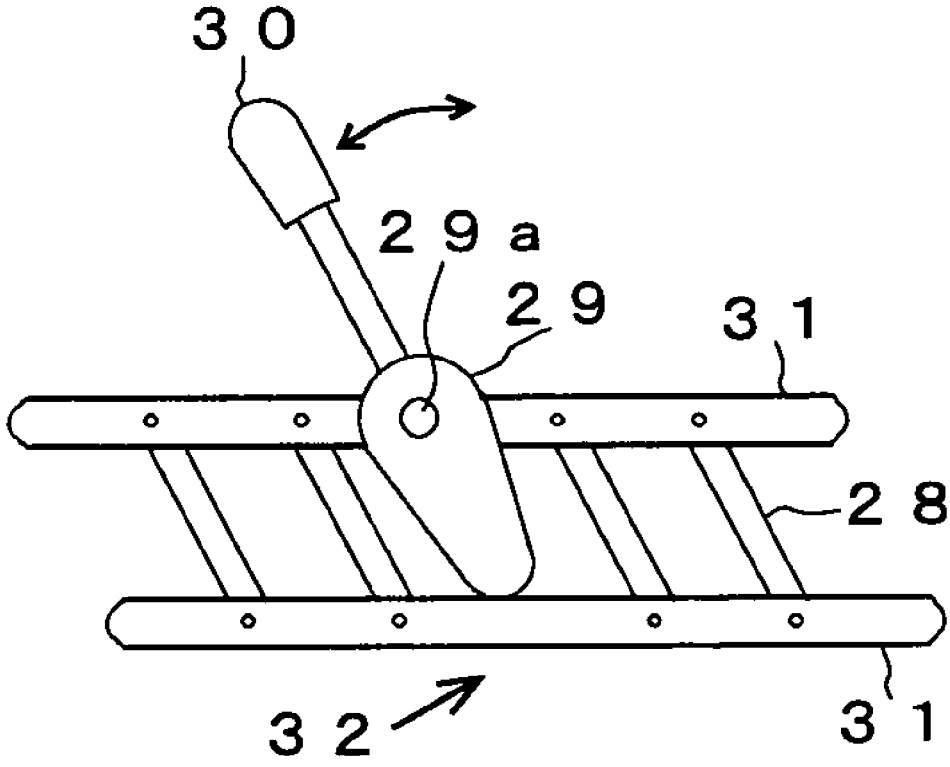
FIG. 7 is a side view of a shake preventive fixing member of the heat exchanger tube panel module.

Furthermore, it is also possible that the heat exchanger tube panels 23 are prevented from being damaged during transportation by a shake preventive fixing member 32 with a pair of rods 31 whose widths are changeable as shown in FIG. 7. The fixing member 32 is a ladder-shaped structure formed by attaching a plurality of bridging arms 28 rotatably supported between the pair of rods 31, wherein a lever 30 unified with a cam 29 is rotated around the rotation center 29*a* of the cam 29 provided on one rod 31 and the front end of the cam 29 is pressed against the other rod 31 to change the distance between the pair of rods 31. The fixing member 32 is inserted into the gap between the transportation frame 24 and the end of the vibration isolating support 18, the distance between the pair of rods 31 is adjusted by operating the cam-attached lever 30, and then the transportation frame 24 and the vibration isolating support 18 are fixed, and after transportation, the fixing member 32 is detached by adjusting the cam-attached lever 30.

Figure 8:
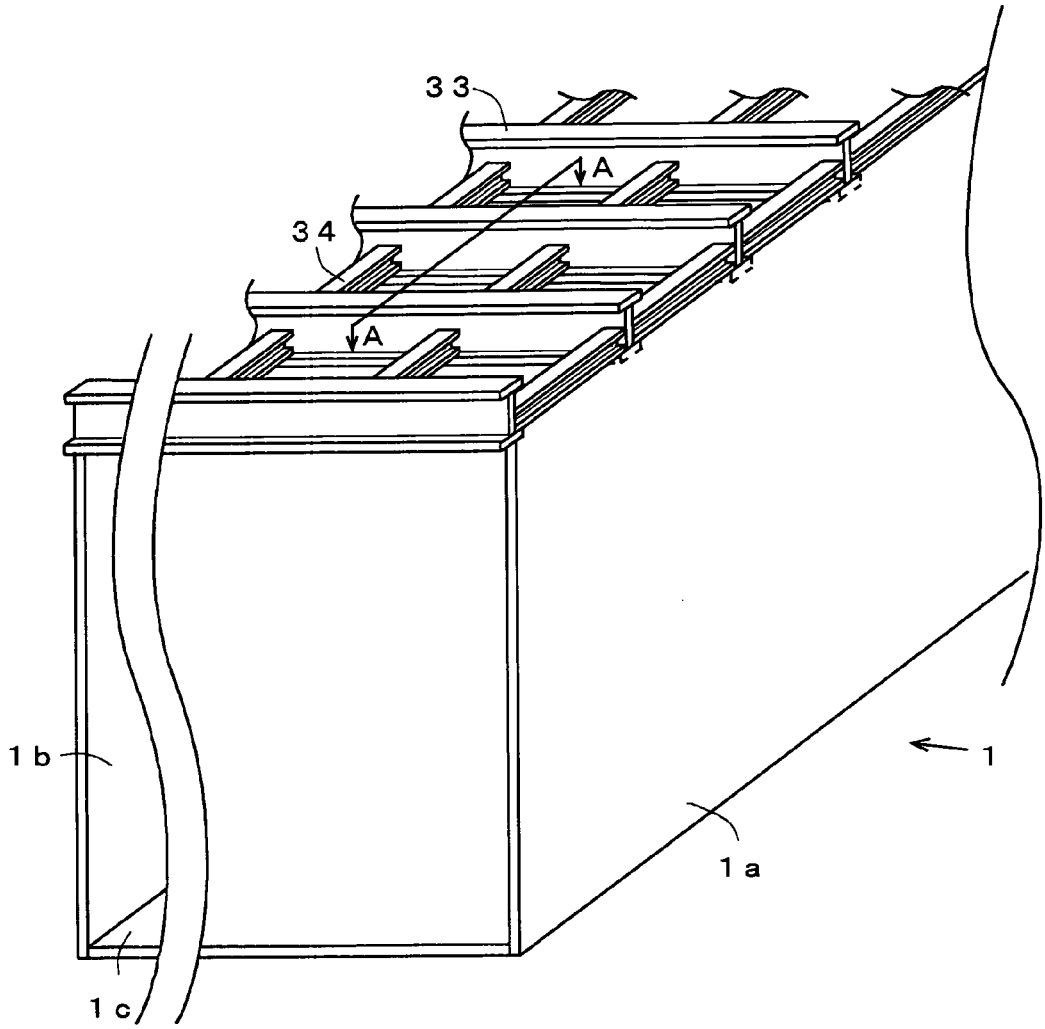
FIG. 8 is a perspective view of a casing constructed in advance at the construction site of the HRSG.

The upper casings 20 inside the modules 25 are casing members which form the ceiling part of the HRSG casing 1 by joining the upper casings 20 of adjacent modules 25, and as shown in FIG. 8, at the HRSG construction site, the HRSG casing 1 is constructed in advance by casing members except for the ceiling part (FIG. 8 shows only the corner part of the casing 1). This casing 1 comprises side casings 1*a* and 1*b* and the bottom casing 1*c*, and heat insulators 21 are attached to the inner surfaces of the side casings 1*a* and 1*b* and the bottom casing 1*c*, respectively, and the respective casings are reinforced by a frame structure formed of unillustrated wide flange beams. At the HRSG ceiling part, no casing is provided, and the casing 1 at the ceiling part is formed by joining the upper casings 20 of the respective modules 25. The heat insulators 21 inside the modules 25 are members for forming heat insulators 13 which are attached to the casing 1 of the HRSG by joining of the heat insulators 21 of adjacent modules 25. The inner casing 19 inside the modules 25 are members for forming the inner casing 12 of the HRSG by joining of the inner casings 19 of adjacent modules 25.

Ceiling part support beams 33 and 34 that simultaneously serve as supporting members formed of wide flange beams for joining the upper casings 20 of the respective modules 25 are provided in advance in a lattice pattern at the ceiling surface of the casing 1 at the construction site.

Figure 9:
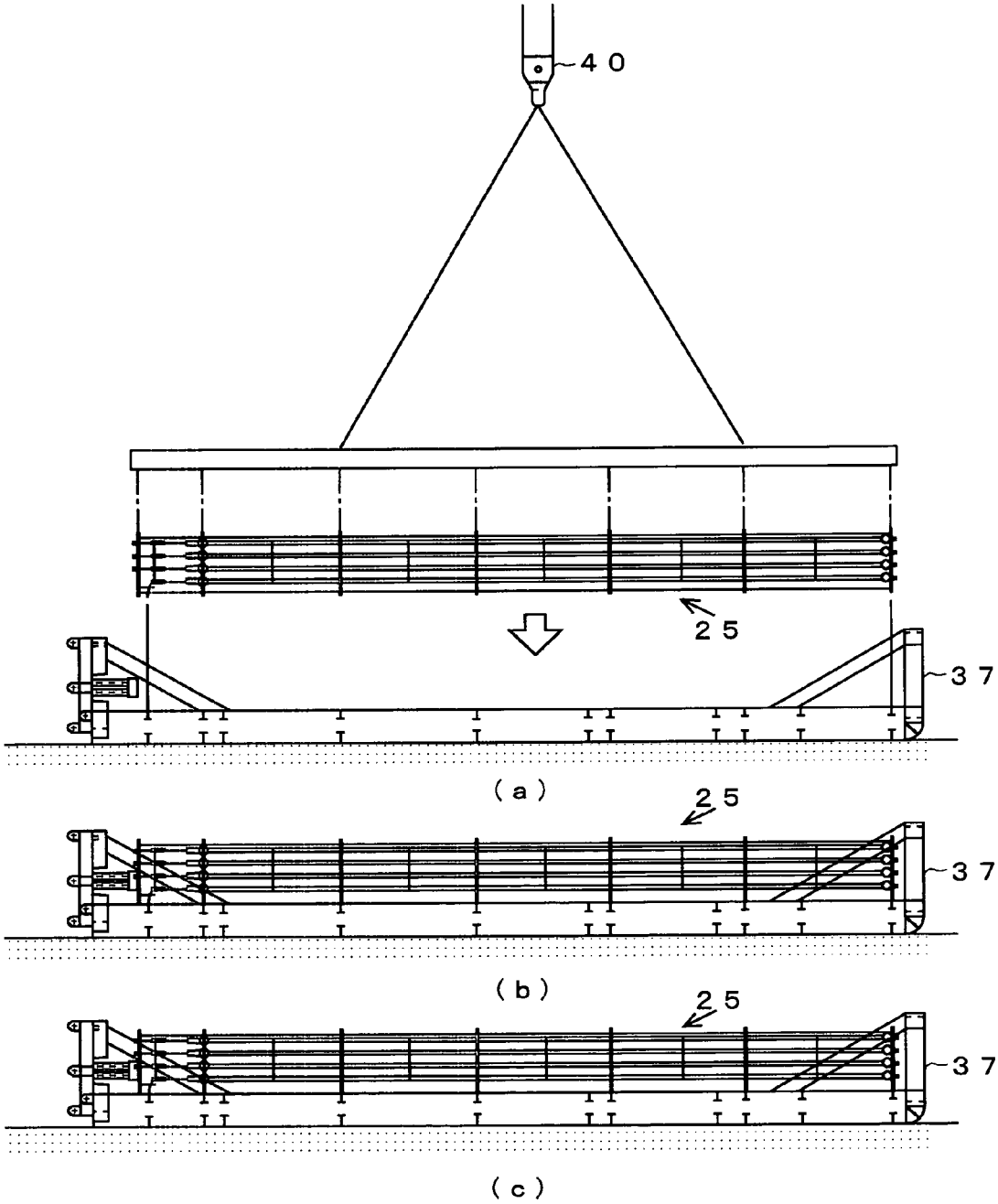
FIGS. 9 are side views showing conditions where the module is placed on a module standing jig.

The modules 25 that have arrived at the HRSG construction site are successively inserted into the opening of the casing 1 between the support beams 33 and 34 of the ceiling part of the casing 1 from above, however, before this operation, each module 25 that has arrived at the site is placed on the module standing jig 37 (FIG. 9(*a*)). Next, points of the module 25 are fixed to the module standing jig 37 (FIG. 9(*b*)), the transportation frame part (not shown) that obstructs lifting of the module 25 is removed, and simultaneously, the fixing members for preventing shake during transportation are also removed (FIG. 9(*c*)).

Figure 10:
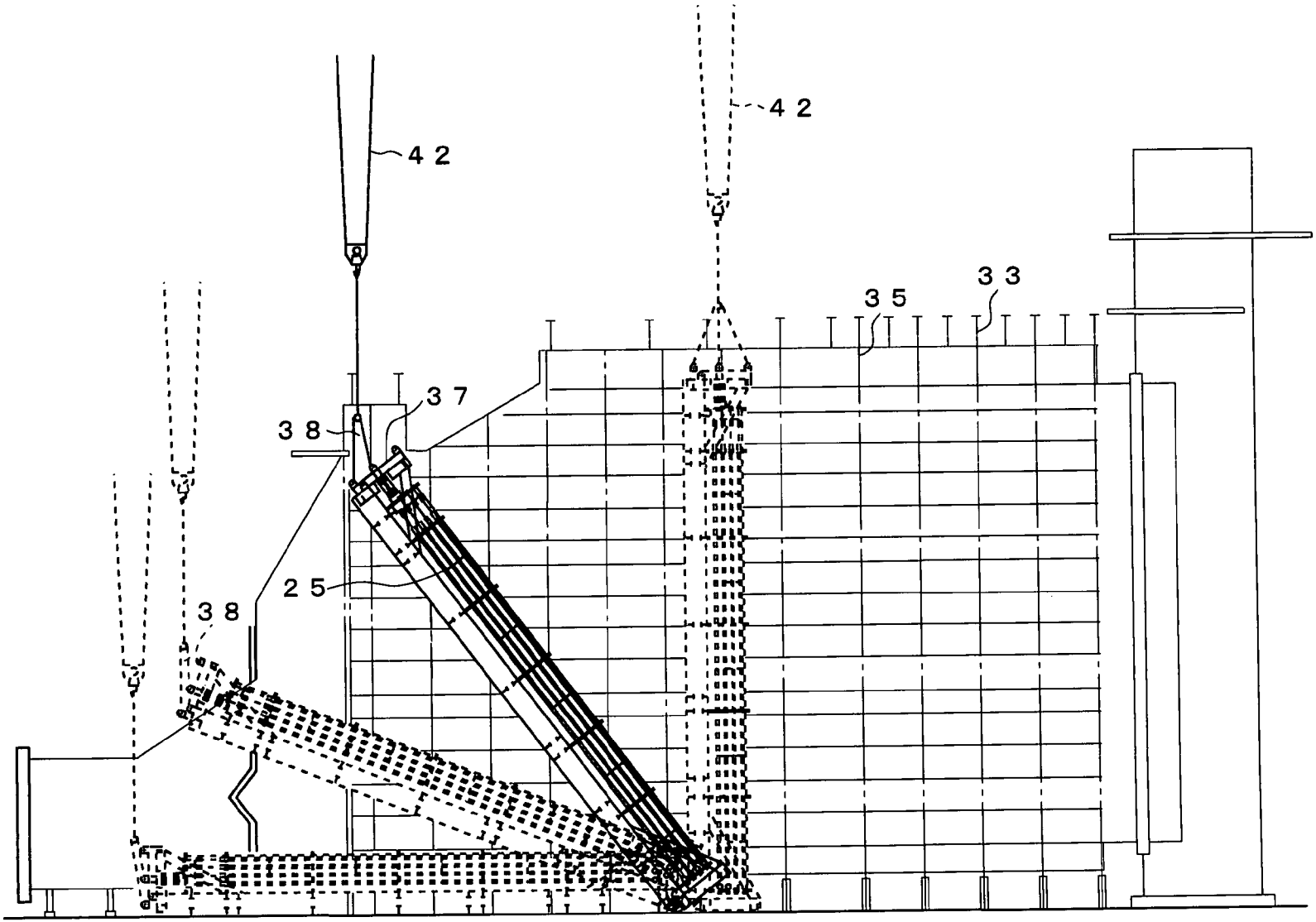
FIG. 10 is a side view showing a condition where the module is lifted by the standing jig.
Figure 11:
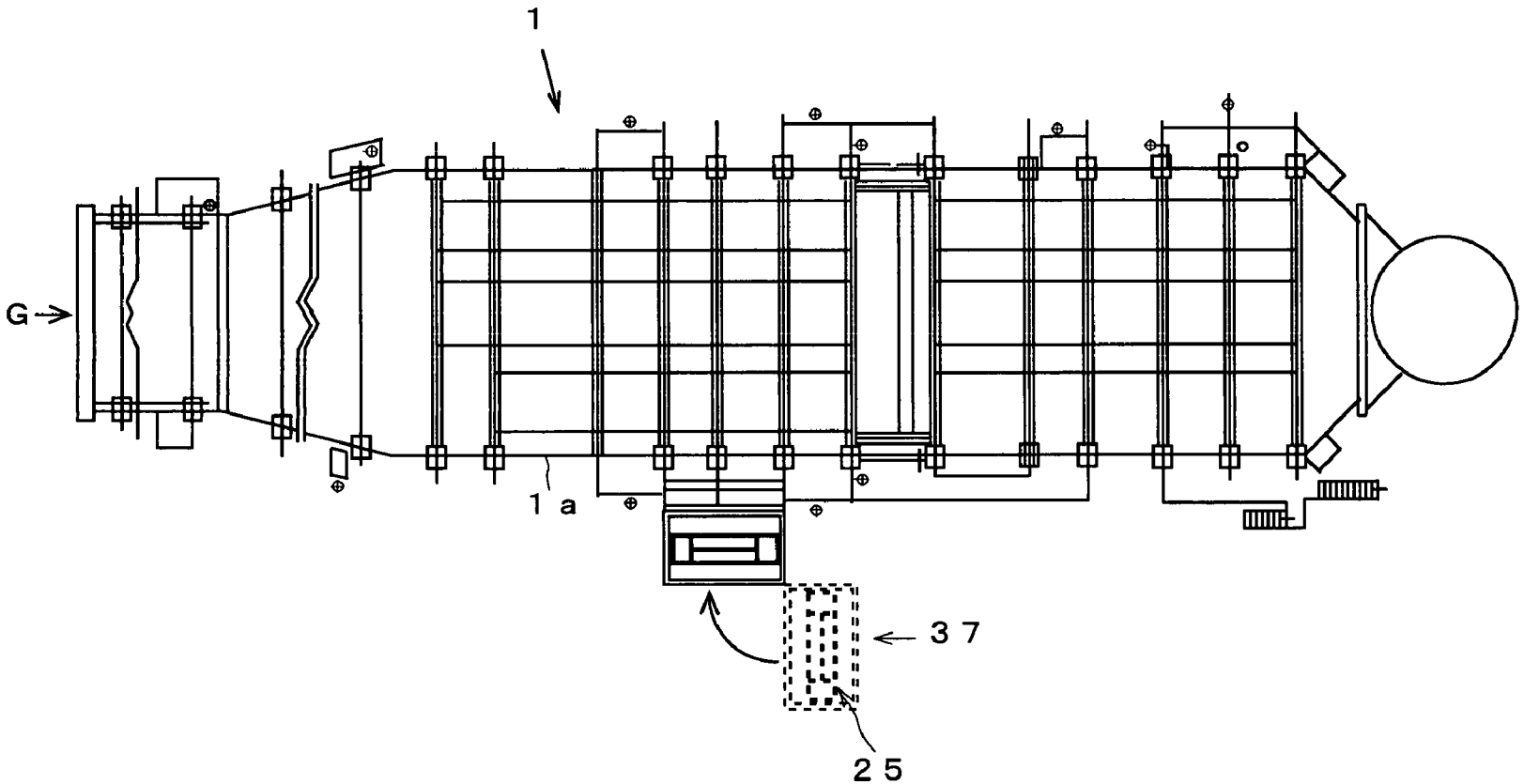
FIG. 11 is a plan view showing the condition where the module is lifted by the standing jig.

At the set location of the standing jig 37, the standing jig 37 is disposed so that the lengthwise direction thereof is along the lengthwise direction of the HRSG casing 1, that is, the gas duct of the HRSG. Therefore, as shown in the HRSG side view of FIG. 10, a wire of the crane 42 hooks a lifting beam 38 attached to the front end of the standing jig 37 to lift the upper casing 20 side of the module 25 upward. At this point, the standing jig 37 is lifted by the crane 42 so as to rotate around the base side of the standing jig 37, and when the lengthwise portion of the standing jig 37 turns to be vertical to the ground, the surfaces of the heat exchanger tube panels 23 on the standing jig 37 which will be set perpendicular to the gas flow (wide plane surfaces) becomes orthogonal to the side casing 1*a* of the HRSG, so that the standing jig 37 is rotated by 90 degrees by the crane 42 as shown in the HRSG plan view of FIG. 11 and the surfaces of the standing jig 37 which will be set perpendicular to the gas flow (wide plane surface) (HRSG plan view) are made parallel to the side casing 1*a*, and then, the standing jig 37 is temporarily fixed to the side casing 1*a*.

Figure 12:
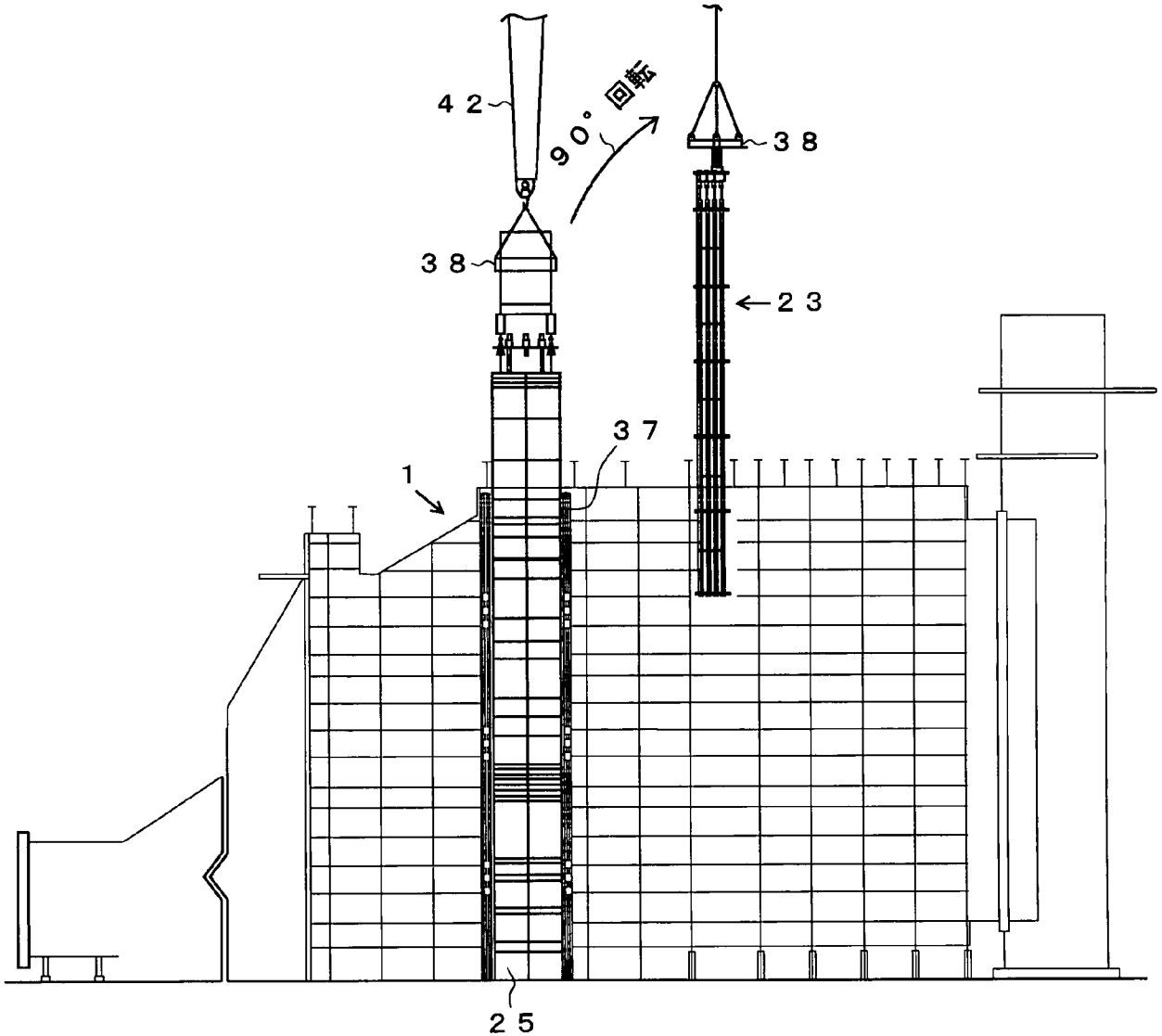
FIG. 12 is a view showing a condition where only the module is lifted by a crane while the standing jig is supported onto the casing side surface.

Thereby, as shown in FIG. 12, in the condition where the standing jig 37 is stably supported onto the side casing 1*a*, the crane 42 that has lifted the lifting beam 38 re-hooks the heat exchanger tube panel support beams 22 of the module 25 and lifts only the module 25. At this point, since the wide plane surfaces of the heat exchanger tube panels 23 of the module 25 which will be set perpendicular to the gas flow are in parallel to the gas flow direction of the HRSG, the module 25 is rotated by 90 degrees again in the lifted condition and brought down and inserted into the opening of the ceiling part of the casing 1 of the HRSG.

Figure 13:
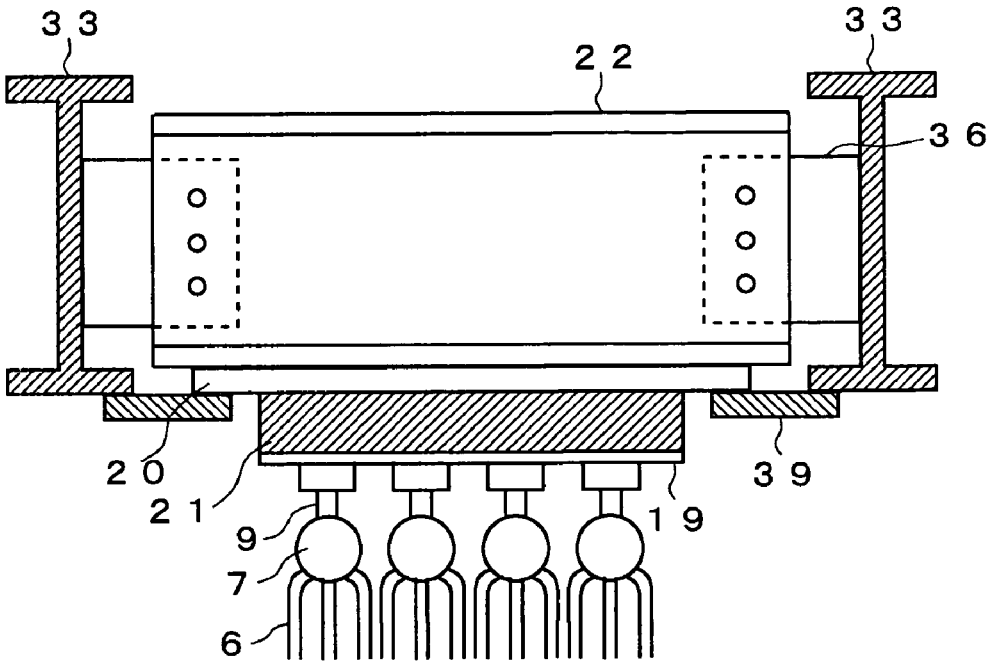
FIGS. 13 are side views of the vicinity of the upper casing of the module inserted into the casing from one opening at the ceiling part of the casing of the HRSG (A-A line cross section of FIG. 8 after attachment of the heat exchanger tube part).
Figure 13:
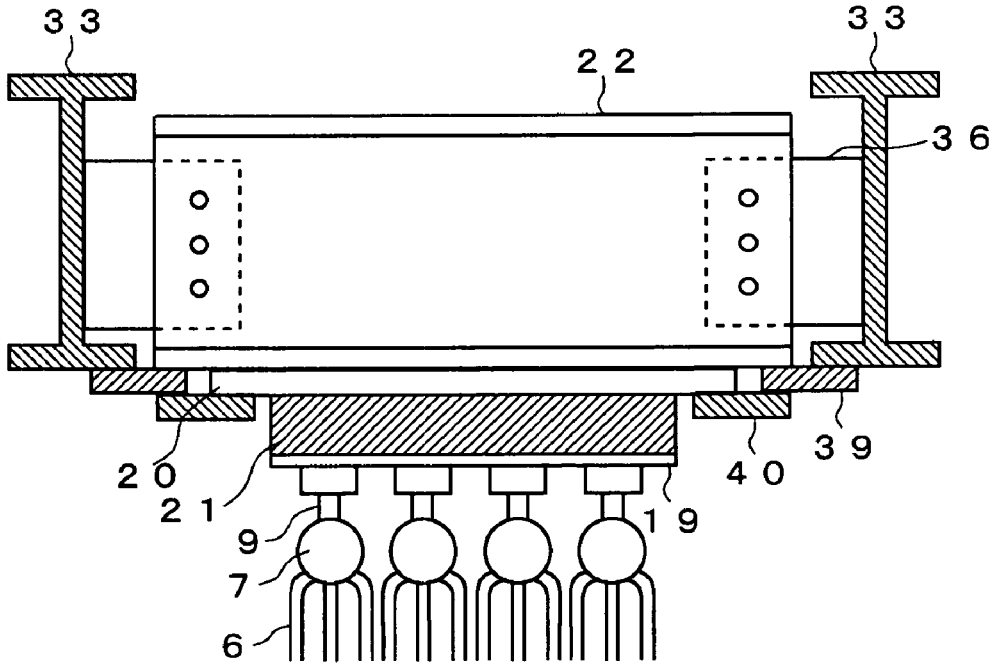

FIG. 13(*a*) is a side view (sectional view along A-A line of FIG. 8 after the heat exchanger tube panel part is attached) of the vicinity of the upper casing 20 of the module 25 inserted inside the casing 1 from one opening of the ceiling part of the casing 1 of the HRSG. The module 25 is brought down between the pair of ceiling part support beams 33 formed of wide flange beams provided at the ceiling part of the HRSG casing 1, and in this case, the upper support beam 22 of the module 25 is disposed at a position overlapped with supporting pieces 36 provided in advance on the side surfaces of the ceiling support beams 33 of the casing 1 and the support beam 22 and the support pieces 36 are connected to each other by rivets, and furthermore, the upper casing 20 and the supporting beams 33 are connected by means of welding to steel plates 39 applied to the gap portions between the upper casing 20 and the support beams 33.

As shown in FIG. 13(*b*), it is also possible that the steel plates 39 are welded in advance below the pair of support beams 33 formed of wide flange beams of the casing 1, and after the supporting pieces 36 provided on the side surfaces of the supporting beams 33 of the casing 1 and the upper support beams 22 of the module 25 are connected by rivets, the upper casing 20 of the module 25 and the steel plates 39 are connected by means of welding to each other by using steel plates 40 applied to the gap portions between the upper casing 20 and the steel plates 39. In this case, welding can be carried out from the upper side of the ceiling part of the casing 1, and this improves the connecting workability.

Thereby, by installing the heat exchanger tube panel modules 25 on site, installation of the heat exchanger tube bundle is completed along with the HRSG casing 1. Furthermore, in this embodiment, since dangerous construction work at the upper side inside the casing 1 of the HRSG is eliminated, setting up of scaffolds and dismounting thereof also become unnecessary, and the heat exchanger tube panels 23 can be easily installed into the casing 1 of the HRSG in a short period of time, so that the HRSG can be constructed within a short work period.

Figure 14:
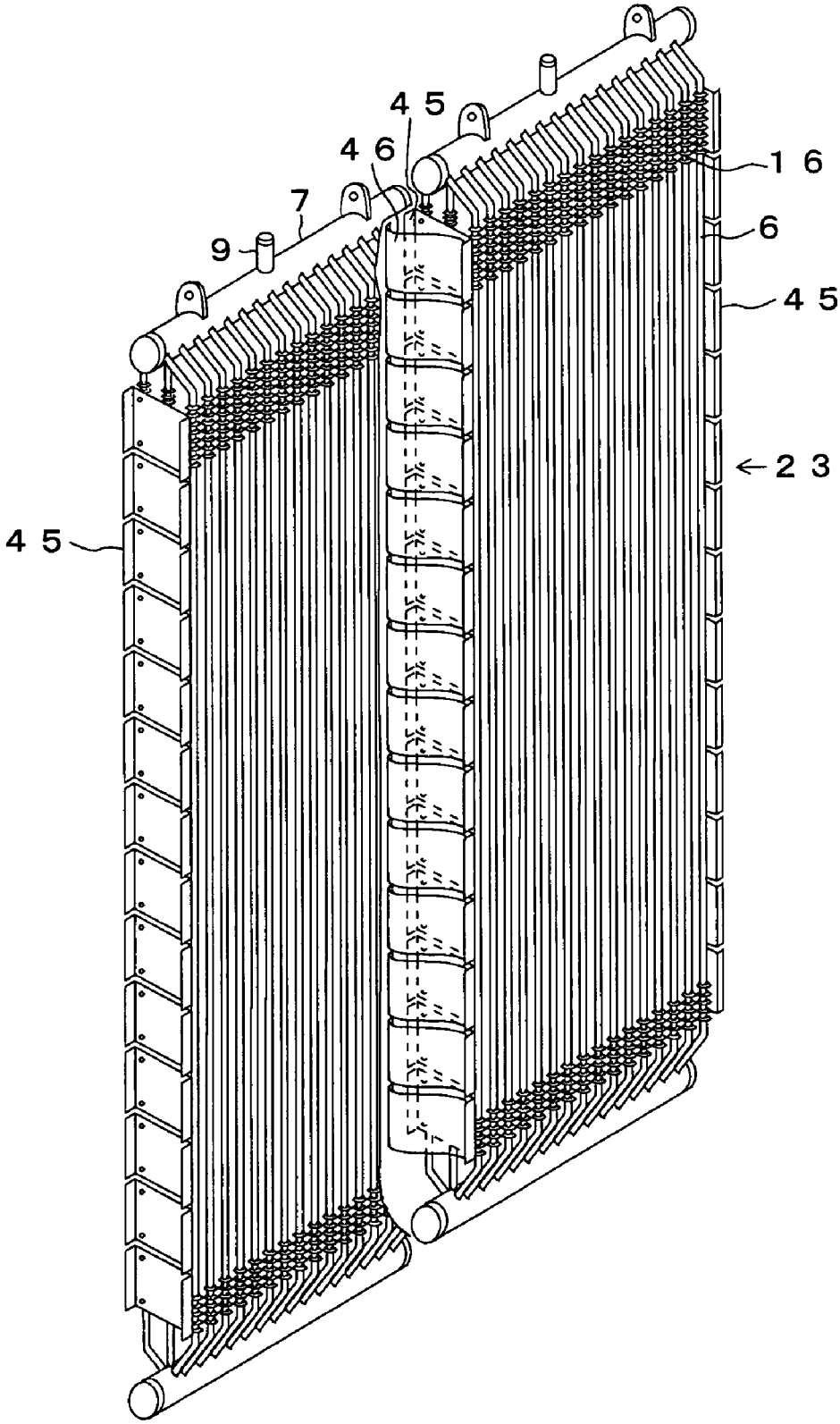
FIG. 14 is a perspective view of heat exchanger tube panels arranged in parallel in the gas path width direction of the exhaust heat recovery boiler as an embodiment of the invention.
Figure 15:
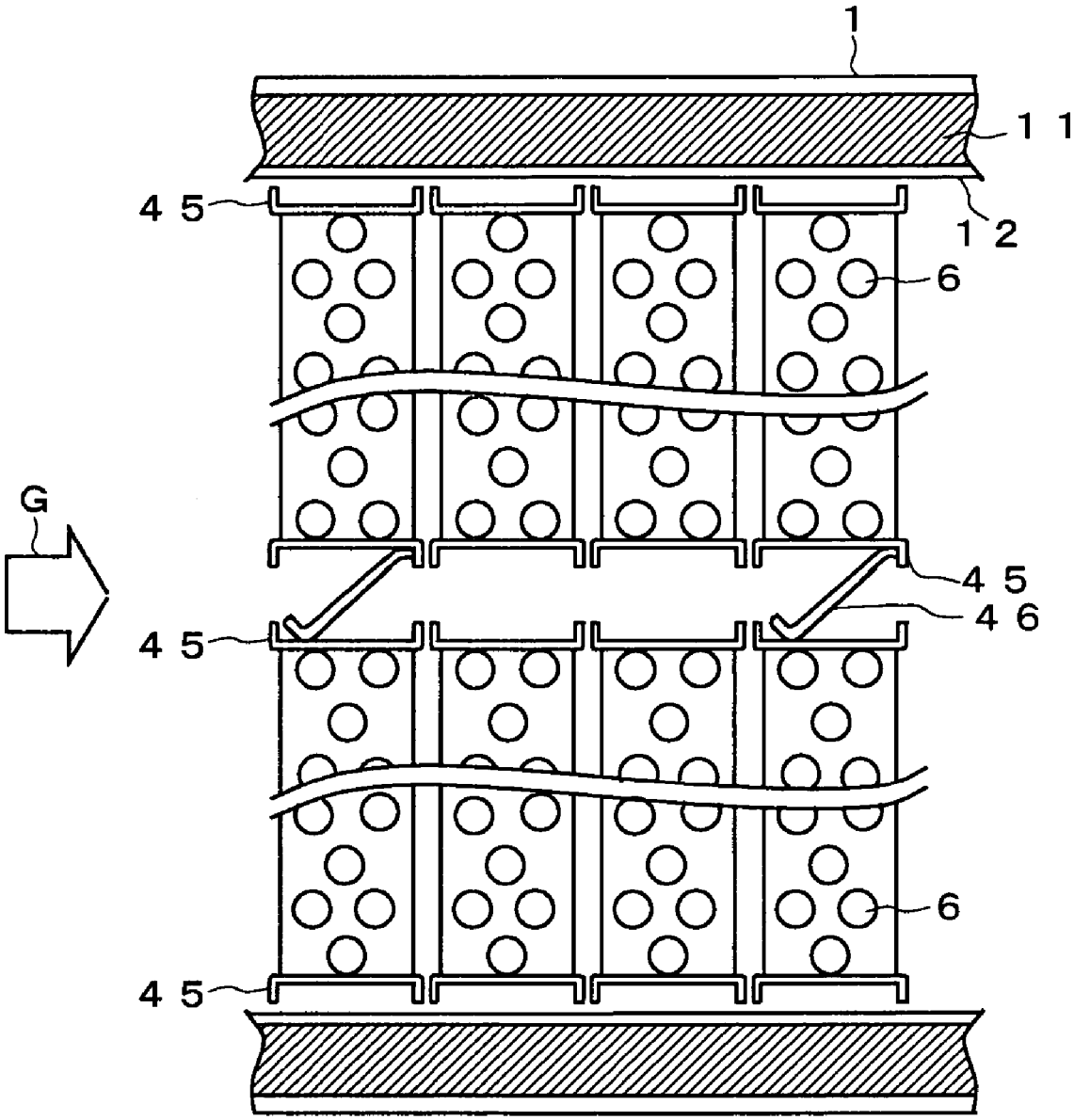
FIG. 15 is a plan view of FIG. 14.

Furthermore, only the heat exchanger tube panels 23 arranged in parallel in the gas path width direction of the exhaust heat recovery boiler of an embodiment of the invention are shown in the perspective view of FIG. 14 and the plan view of FIG. 15, wherein baffle plates 45 are provided on the side surfaces along the gas flow of the heat exchanger tube panels 23, and gas short pass preventive plates 46 for preventing short pass of gas are further provided.

Both side surfaces of each heat exchanger tube plate panel 23 are provided with baffle plates 45, and these prevent short pass of gas from the gap between the heat exchanger tube panel 23 and the casing 1, however, the gaps between the heat exchanger tube panels 23 arranged in parallel in the gas path width direction of the exhaust heat recovery boiler as in this embodiment cannot be filled up by only the baffle plates 45. The reason for this is that provision of the gap between the adjacent heat exchanger tube panels 23 is necessary for the installation work of the heat exchanger tube panels 23 and thermal elongation of the panels 23.

Figure 16:
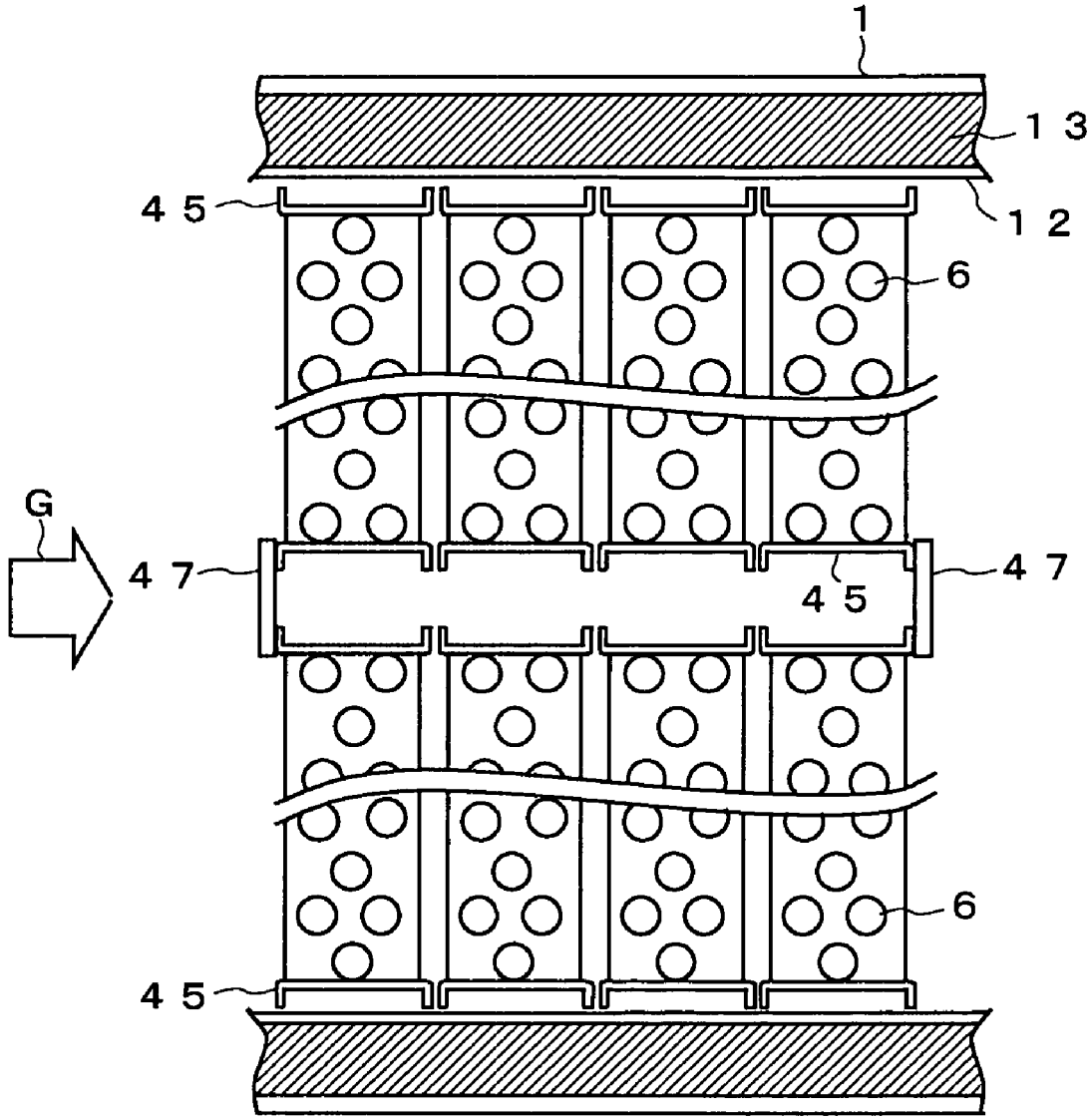
PRIOR ART FIG. 16
FIG. 16 is a plan view of the portion of heat exchanger tube panels arranged in parallel in a gas path width direction of a conventional exhaust heat recovery boiler.

If the gap is left as it is, gas passes through the gap, and as a result, the gas amount to pass through the heat exchanger tube panels 23 is reduced and the amount of recovered heat is lowered. Therefore, conventionally, after installation of the heat exchanger tube panels 23, in the gap between the heat exchanger tube panels 23, as shown in the plan view of FIG. 16, gas short pass preventive plates 47 are set at the gas inlet and the gas outlet between the baffle plates 45 of adjacent panels 23. However, since the gas short pass preventive plates 47 are set after setting up scaffolds in the elevation direction including high locations, safety measures, etc., such as worker falling prevention measures for works at high locations are taken, and this lengthens the installation work period.

Therefore, in this embodiment, gas short pass preventive plates 46 are attached in advance in the factory, etc., to the baffle plates 45 of one of adjacent heat exchanger tube panels 23 at positions corresponding to the gas inlet and gas outlet of the respective heat exchanger tube panels 23 and brought into the construction site, and the heat exchanger tube panel 23 attached with the gas short pass preventive plates 46 is installed first. One side surface of the rectangular gas short pass preventive plate 46 is attached to the baffle plate 45, and the opposite side surface is left free.

After the heat exchanger tube panel 23 attached with the gas short pass preventive plates 46 is installed at a construction site, the other adjacent heat exchanger tube panel 23 without the gas short pass preventive plates 46 arranged in parallel is installed, and at this point, the other heat exchanger tube panels 23 are installed so that the gas short pass preventive plates 46 are in contact with the baffle plates 45 of the opposite heat exchanger tube panel 23.

Thereby, when gas flows, the free side surfaces of the gas short pass preventive plates 46 come into pressure-contact with the baffle plates 45 of the opposite heat exchanger tube panel 23 at the gas inlet side, the gap between the two heat exchanger tube panels 23 is eliminated, and gas short pass is prevented.

Furthermore, when the free side surfaces of the gas short pass preventive plates 46 are folded, the gas flow is efficiently trapped into the folded portions, so that the gas short pass preventive plates 46 are more securely pressed against the baffle plates 45 of the opposite heat exchanger tube panels 23, whereby the gap is eliminated and gas short pass is reliably prevented.

As mentioned above, by attaching in advance the gas short pass preventive plates 46 to the baffle plates 45 provided on both side surfaces of each heat exchanger tube panel 23 at the equipment factory, etc., it becomes unnecessary to set scaffolds for attachment works at the HRSG construction site, and this shortens the installation work period of the gas short pass preventive plates 46 and secures safety in the installation work.

INDUSTRIAL APPLICABILITY

In the invention, by employing a construction in which a part (module frames 24 and 25) of strength members including main columns 33 and main beams 34 of an HRSG are commonly used as components of the heat exchanger tube panel modules 20, in a case where the heat exchanger tube bundle modules 20 of the exhaust heat recovery boiler are installed at a construction site, a structure with high installation workability at the HRSG construction site can be applied to joint portions between the modules 20 and between the modules 20 and the strength members of the HRSG.

Furthermore, the bottom beams 36 as strength members set in advance at the HRSG construction site are made wider than the main columns 33, whereby the installation work labor of the heat exchanger tube panel modules 20 can be reduced, the construction process of the combined cycle power plant can be rationalized, and the local installation costs can be reduced.

Furthermore, after construction of the HRSG, the module frames 24 and 25 serve as a part of the strength members of the HRSG such as the main columns 33 and the main beams 34, so that it is advantageous that members to be scrapped after construction are virtually nil.

Furthermore, since shake preventive fixing members are provided between the vibration isolating supports 18 arranged at predetermined intervals and the casing 1 to prevent contact between adjacent heat exchanger tubes 6 during transportation of the heat exchanger tube panel modules 20, the heat exchanger tube panel modules 20 can be prevented from being damaged during transportation, whereby transportation of the heat exchanger tube panel modules 20 to a remote site becomes easy.

Furthermore, between two heat exchanger tube panels 23 adjacent in the gas path width direction (direction orthogonal to the gas flow), a gas short pass preventive plate 46 is provided on one side surface of which is connected to the baffle plate 45 of one of the heat exchanger tube panels 23 and the other side surface of which comes into contact with the baffle plate 45 of the other heat exchanger tube panel 23, and in particular, by folding the side surface of the gas short pass preventive plate 46 which comes into contact with the baffle plate 45 of the heat exchanger tube panel 23 toward the upstream side inside the gas duct, gas short pass between the two heat exchanger tube panels 23 is prevented, whereby heat retained in gas can be efficiently recovered.

Furthermore, by attaching in advance one-side surfaces of the gas short pass preventive plates 46 to the baffle plates 45 of the heat exchanger tube panels 23 on one side, the heat exchanger tube panels 23 with the gas short pass preventive plates 46 can be set without internal furnace scaffolds at the HRSG construction site, and this shortens the installation work period and is preferable in terms of safety of the installation work since works at high locations are eliminated.

What is claimed is:

1. A construction method for an exhaust heat recovery boiler having a heat exchanger tube bundle positioned within a casing which defines a gas duct in which exhaust gas flows generally horizontally to generate steam, the construction method comprising:

providing a heat exchanger tube bundle comprising a plurality of modules;

providing the plurality of modules such that each of the modules include an assembly, the assembly comprising:

heat exchanger tube panels having a plurality of heat exchanger tubes and corresponding headers, an upper casing provided above the heat exchanger tube panels, and support beams configured to support the heat exchanger tube panels, the support beams being provided on an upper surface of the upper casing in a transportation frame that is formed of a rigid body and used only during transportation;

preparing the plurality of modules according to design specifications of the exhaust heat recovery boiler;

constructing in advance, at a construction site of the exhaust heat recovery boiler, structural members configured to support the modules, the structural members comprising: ceiling part support beams, side casings and a bottom casing of the exhaust heat recovery boiler; and at a construction site of the exhaust heat recovery boiler, surfaces of each module which will be arranged perpendicular to the gas flow are connected to upper and lower sides of the boiler and each module is erected together with the transportation frame, each module is removed from an inside of the transportation frame, and each module is suspended from above and between adjacent ceiling part support beams at a construction site of the exhaust heat recovery boiler, such that the heat exchanger tube panel support beams of each module are positioned at the set heights of the ceiling part support beams, wherein the support beams are connected and fixed to each other via connecting steel plates.

2. The construction method for an exhaust heat recovery boiler according to claim 1, further comprising:

providing a standing jig at a construction site of the exhaust heat recovery boiler, and temporarily fixing the module to the standing jig that has been set at a construction site in advance, erecting the standing jig, on which each module has been placed, with a crane at a position adjacent to the side casing of the exhaust heat recovery boiler so that the lengthwise direction of the standing jig rotates toward the vertical direction, surfaces of each module which will be arranged perpendicular to the gas flow are arranged so as to be along the side casing of the exhaust heat recovery boiler, the standing jig being temporarily fixed to the side casing, and an object to be lifted by the crane becomes the heat exchanger tube panel support beams of the module placed inside the standing jig which is temporarily fixed to the side casing, the module is lifted up and taken off the standing jig, and the module lifted by the crane is suspended from above and between adjacent ceiling part support beams of the supporting structural members for the modules of the exhaust heat recovery boiler.

3. The construction method for an exhaust heat recovery boiler according to claim 1, wherein after the heat exchanger tube panel support beams of the respective modules are disposed at the heights of the ceiling part support beams and the support beams are connected and fixed by using first connecting steel plates, gaps created between the upper casings of the respective modules and the ceiling part support beams are closed by using second steel plates, and the upper casings, the ceiling part support beams, and the second steel plates are connected by welding.

4. Heat exchanger tube panel modules for an exhaust heat recovery boiler construction, wherein one module unit comprises a heat exchanger tube panel module that comprises an assembly, the assembly comprising:

heat exchanger tube panels having a plurality of heat exchanger tubes and corresponding headers, an upper casing provided above the heat exchanger tube panels, and support beams configured to support the heat exchanger tube panels, the support beams being provided on the upper surface of the upper casing, and a transportation frame that is formed of a rigid body and houses the module, the transportation frame being used only during transportation;

vibration isolating supports which are provided at predetermined intervals on the heat exchanger tube panels of the one module unit to prevent contact between adjacent heat exchanger tubes in a direction which traverses the lengthwise direction of the heat exchanger tubes; and baffle plates configured to prevent gas short pass, the baffle plates being connected to opposing side surfaces of the heat exchanger tube panels along a gas flow direction of each heat exchanger tube panel, the baffle plates extending along corresponding sides of heat exchanger tube panels so as to be adjacent to each other in a direction orthogonal to the gas flow, corresponding gas short pass preventive plates extending between a corresponding side surface provided by one of the opposing side surfaces to which a corresponding baffle plate is connected and a corresponding side surface providing by another of the opposing side surfaces to which a corresponding baffle plate is connected, wherein each of the gas short pass preventive plates contact opposing baffle plates provided on corresponding opposing side surfaces of the heat exchanger tube panel.

5. The heat exchanger tube panel modules for an exhaust heat recovery boiler construction according to claim 4, wherein corresponding side surfaces of the gas short pass preventive plate, which come into contact with corresponding baffle plates of the heat exchanger tube panel, is folded toward an upstream side of the gas flow.

* * * * *